US009189980B2

(12) United States Patent
Kidd

(10) Patent No.: US 9,189,980 B2
(45) Date of Patent: Nov. 17, 2015

(54) VEHICLE FLAG POLE ASSEMBLY

(71) Applicant: James Leigh Kidd, Joplin, MO (US)

(72) Inventor: James Leigh Kidd, Joplin, MO (US)

( * ) Notice: Subject to any disclaimer, the term of this patent is extended or adjusted under 35 U.S.C. 154(b) by 386 days.

(21) Appl. No.: 13/734,507

(22) Filed: Jan. 4, 2013

(65) Prior Publication Data

US 2014/0014023 A1 Jan. 16, 2014

Related U.S. Application Data

(60) Provisional application No. 61/583,440, filed on Jan. 5, 2012.

(51) Int. Cl.
*G09F 17/00* (2006.01)

(52) U.S. Cl.
CPC ..... *G09F 17/00* (2013.01); *G09F 2017/0075* (2013.01)

(58) Field of Classification Search
USPC ..... 16/375; 248/682, 689; 403/202, 242
See application file for complete search history.

(56) References Cited

U.S. PATENT DOCUMENTS

| | | | | |
|---|---|---|---|---|
| 6,302,567 | B1 * | 10/2001 | Gamble, Sr. | 362/505 |
| 6,463,686 | B1 * | 10/2002 | Eisenbraun | 40/591 |
| 7,503,135 | B2 * | 3/2009 | Chafin | 40/591 |
| 2003/0071185 | A1 * | 4/2003 | Casapulla | 248/534 |
| 2003/0094473 | A1 * | 5/2003 | Moore | 224/519 |
| 2006/0053667 | A1 * | 3/2006 | Andersen | 40/591 |
| 2008/0073398 | A1 * | 3/2008 | Plaschka | 224/519 |

OTHER PUBLICATIONS

Non-Patent Literature "Electrical & Hitching Requirements", accessed at http://web.archive.org/web/20051029055617/http://www.limo.net/rv/wiring.html, archived Oct. 29, 2005.*

Non-Patent Literature "AUTOMOBRELLA", accessed at http://web.archive.org/web/20040603063227/http://www.shadeusa.com/hitch_umbrella_holder.htm, archived on Jun. 3, 2004.*

* cited by examiner

*Primary Examiner* — Daniel S Larkin

*Assistant Examiner* — Irving A Campbell

(74) *Attorney, Agent, or Firm* — Mashburn Law Office, LLC; Donna Denise Mashburn

(57) ABSTRACT

A flag pole assembly for use with a vehicle having a trailer hitch, the flag pole assembly comprising a horizontal member having oppositely disposed first and distal ends, wherein the horizontal member includes a first hole in the first end to attach the horizontal member to the hitch of a vehicle and the horizontal member is at least thirty inches long, a vertical member coupled to the distal end of the horizontal member and the vertical member extends upward, and at least one attachment link is affixed to the vertical member for attaching a first ornament.

9 Claims, 10 Drawing Sheets

VEHICLE FLAG POLE ASSEMBLY

CROSS REFERENCES TO RELATED APPLICATIONS

Applicant claims priority under 35 USC 119(e) to provisional application 61/583,440 filed on Jan. 5, 2012.

FIELD OF INVENTION

The present invention relates generally to a flag pole assembly that attaches to a vehicle's trailer hitch. In particular, the invention relates to a flag pole assembly capable of being secured to the trailer hitch of a vehicle for the purpose of displaying a flag, banner, and/or windsock. A sports team ornament, e.g., a logo, graphic, mascot, nickname, and/or chant, may also be displayed above and below the flag to promote allegiance to a particular team. An elongated first member permits a user to open and close the vehicle tailgate without interference from the flag pole assembly.

BRIEF DESCRIPTION OF THE DRAWINGS

The accompanying drawings illustrate embodiments of the invention and are for illustration by way of example and not limitations.

DETAILED DESCRIPTION OF THE INVENTION

The present invention is to a flag pole assembly 100 as shown in FIGS. 1-10. Specifically, the invention is a flag pole assembly 100 that is capable of being secured to the trailer hitch of a vehicle 102 (FIG. 1), and the assembly 100 extends out far enough to permit a user to open and close the vehicle tailgate without inference from the assembly 100.

Figure 1:
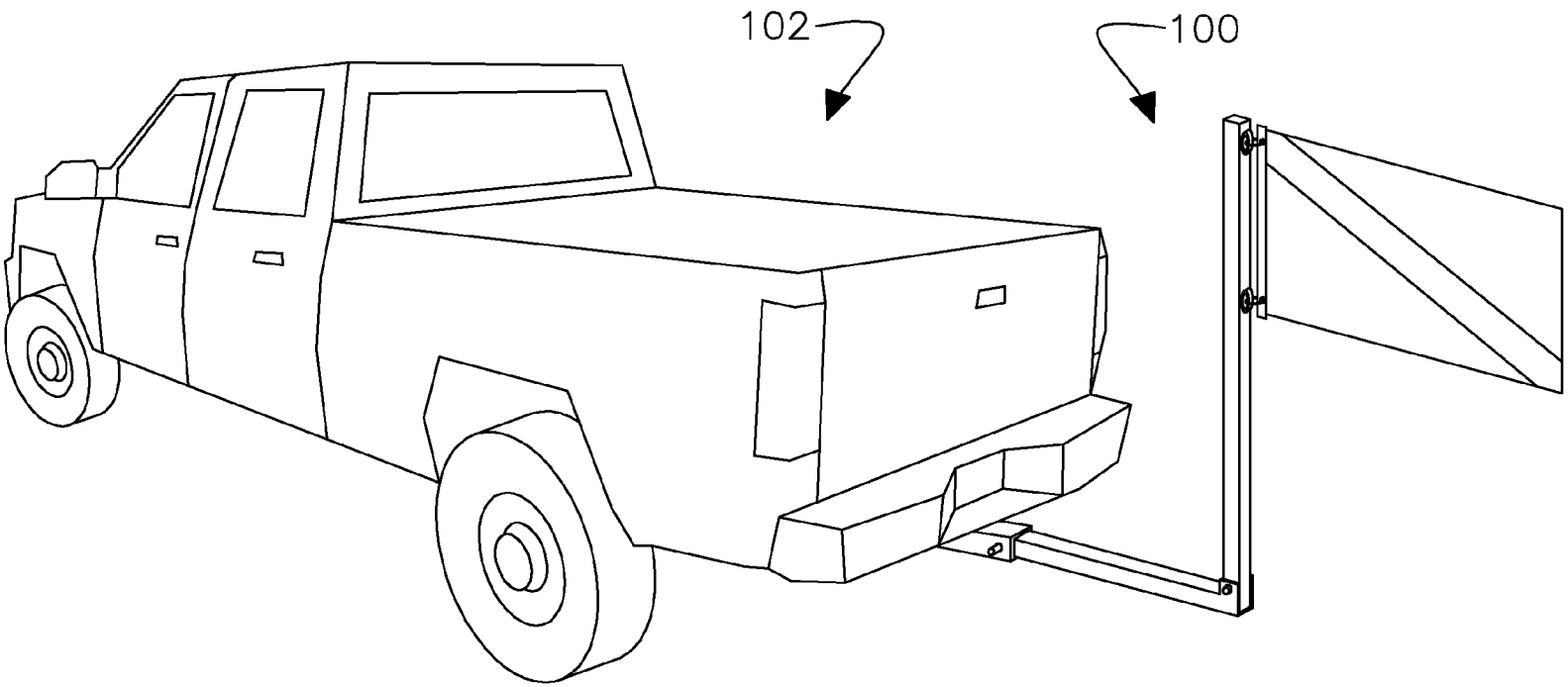
FIG. 1 illustrates a top perspective view of a flag pole assembly secured to the trailer hitch of a truck, in accordance with an embodiment of the invention.
Figure 2:
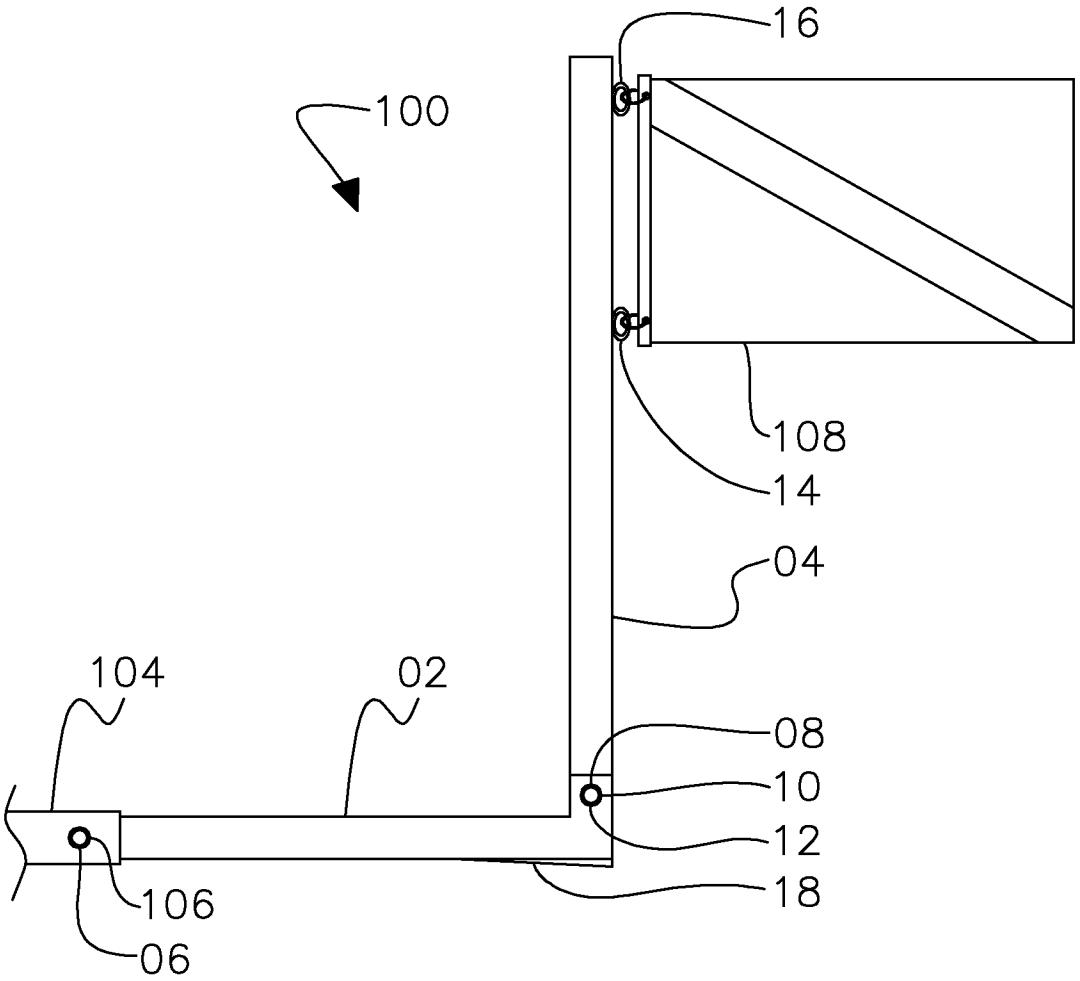
FIG. 2 illustrates an elevation view of the flag pole assembly shown in FIG. 1, including a first ornament, wherein the assembly is in an erect configuration and secured to a trailer hitch, in accordance with an embodiment of the invention.

As shown in FIG. 2, the flag pole assembly 100 includes a generally horizontal member 02 at least thirty inches in length and presenting a first and a distal end, and a generally vertical member 04 presenting a base and a top end, the vertical member 04 extending from the distal end of the horizontal member 02. The members are made of any rigid material, including but not limited to metal, such as steel or aluminum, wood, plastic, or other man-made materials. The horizontal member 02 and the vertical member 04 may be hollow or solid. The horizontal member 02 has a first hole 06 in a first end that allows the user to attach the horizontal member 02 to a trailer hitch receiver 104 by inserting a first fastener 106 through the first hole 06. The fastener 106 can be a pin, screw, bolt, rivet, or any similar fastener. The distal end of the horizontal member 02 is joined to the vertical member 04 by welding, bonding, or fastening. The horizontal member 02 further includes at least a second hole 08 hear the distal end, and the vertical member 04 includes at least a third hole 10 near the base, wherein the second hole 08 and third hole 10 are aligned. A second fastener 12 is inserted through the second hole 08 and third hole 10. The horizontal member 02 and vertical member 04 may include additional holes for receiving additional fasteners. The vertical member 04 further includes at least one attachment link 14 near the top end operable to secure a first ornament 108 to the vertical member 04.

In one embodiment, as shown in FIG. 2, the vertical member 04 further includes a second attachment link 16 spaced approximately the vertical length of the first ornament 108 from at least one attachment link 14. The attachment links 14, 16 can be made of metal, plastic, or other man-made materials and can be attached to the vertical member 04 in various ways, including but not limited to welding and bonding. The first ornament 108 can be a flag, banner, windsock, or similar display that is attached to the flag pole assembly 100 and is used to display team spirit or other passion.

Figure 3:
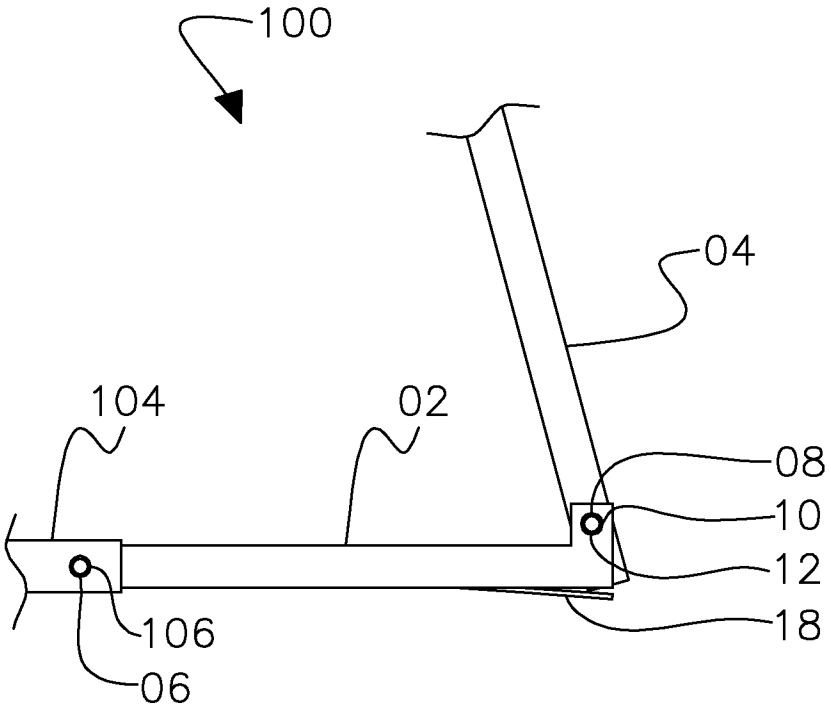
FIG. 3 illustrates an elevation view of the flag pole assembly shown in FIG. 1, including a securing tab, and in an intermediate configuration, in accordance with an embodiment of the invention.
Figure 4:
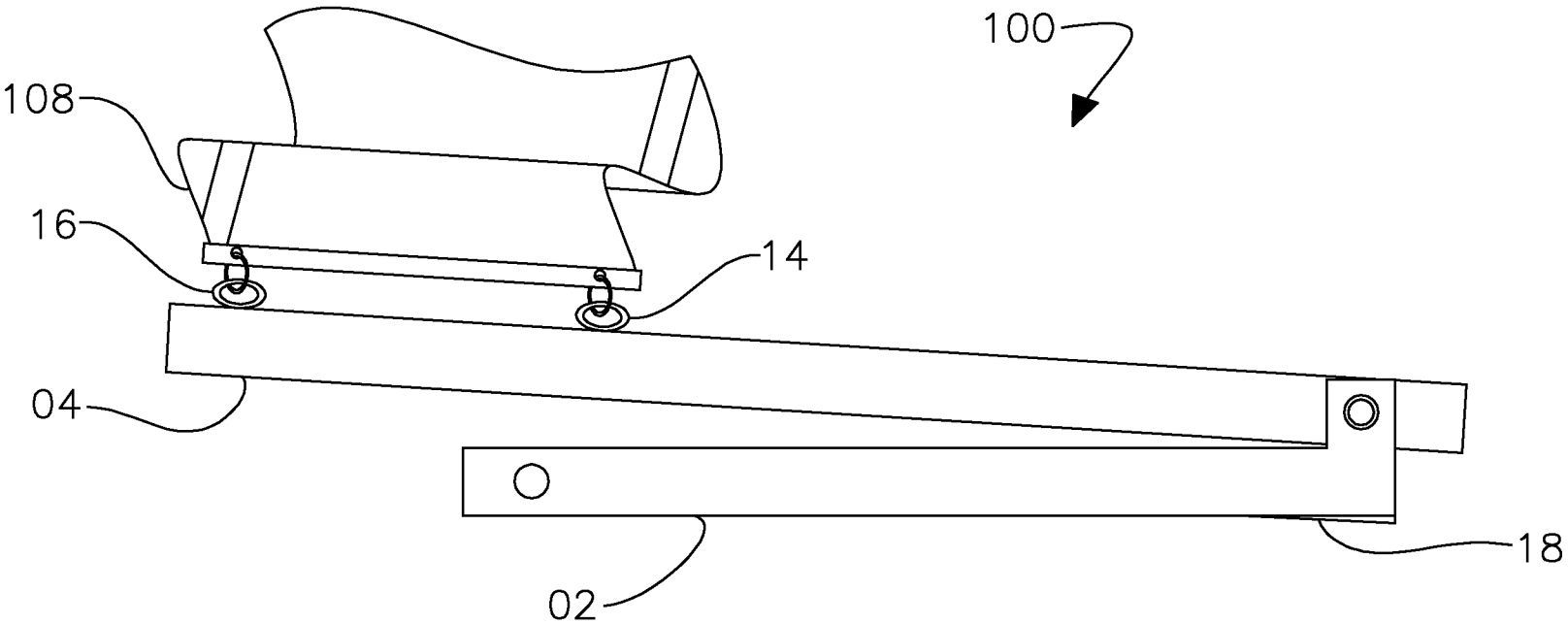
FIG. 4 illustrates an elevation view of the flag pole assembly shown in FIG. 1, in a stored configuration, in accordance with an embodiment of the invention.

In another embodiment of the invention, as shown in FIGS. 2-4, the horizontal member 02 further includes a securing tab near the distal end and engaging the base of the vertical member 04. The securing tab 18 is biased toward a secured configuration, whereby the vertical member 04 is constrained to an erect configuration (FIG. 2). The user may apply a force to the vertical member 04 sufficient to overcome the bias, whereby the vertical member 04 and securing tab 18 present an intermediate configuration (FIG. 3). Further application of the force causes the vertical member 04 to become disengaged from the securing tab 18, thereby resulting in the vertical member 04 being folded toward the horizontal member 02 in a stored configuration, as shown in FIG. 4.

Figure 5:
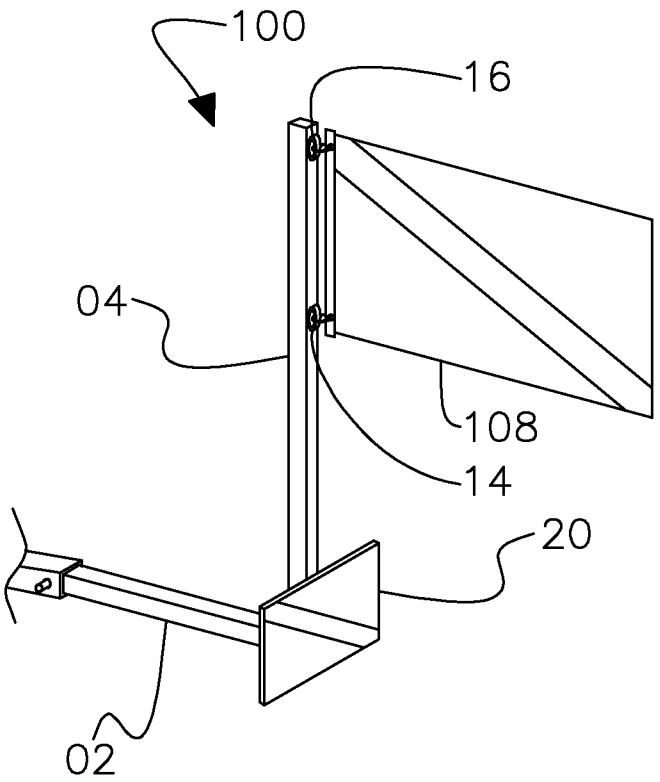
FIG. 5 illustrates a top perspective view of a flag pole assembly including a first ornament attached near the top of a vertical member and a second ornament attached near the base of the vertical member, in accordance with an embodiment of the invention.

In another embodiment of the invention, as shown in FIG. 5, a second ornament 20 is attached below the first ornament 108 near the base of the vertical member 04 to further display team pride. The second ornament 20 may be attached to vertical member 04 in various ways, including but not limited to welding, bonding, and fastening. The second ornament 20 shown in FIG. 5 is a team name, logo, graphic, or mascot made of metal, plastic, or another man-made material. Like the first ornament 108, the second ornament 20 is easily visible during the day and is illuminated at night by the vehicle's brake lights.

Figure 6:
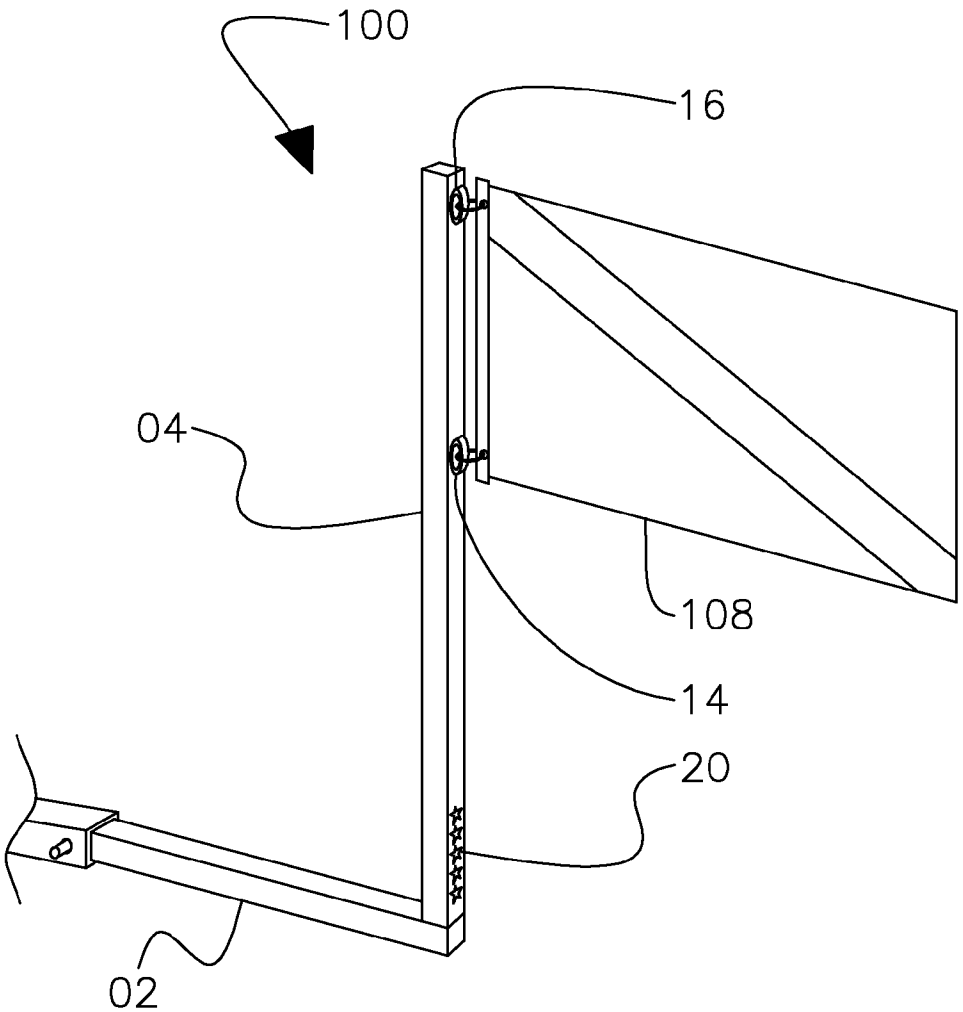
FIG. 6 illustrates an elevation top perspective view of a flag pole assembly including an alternative embodiment of the second ornament, in accordance with an embodiment of the invention.

Another embodiment of the second ornament 20 is shown in FIG. 6, wherein the second ornament 20 is either an appliqué or sticker of a team name, logo, graphic, or mascot that is applied to the base of the vertical member 04 or a team name, logo, graphic, or mascot that is painted on the base of the vertical member 04.

Figure 7:
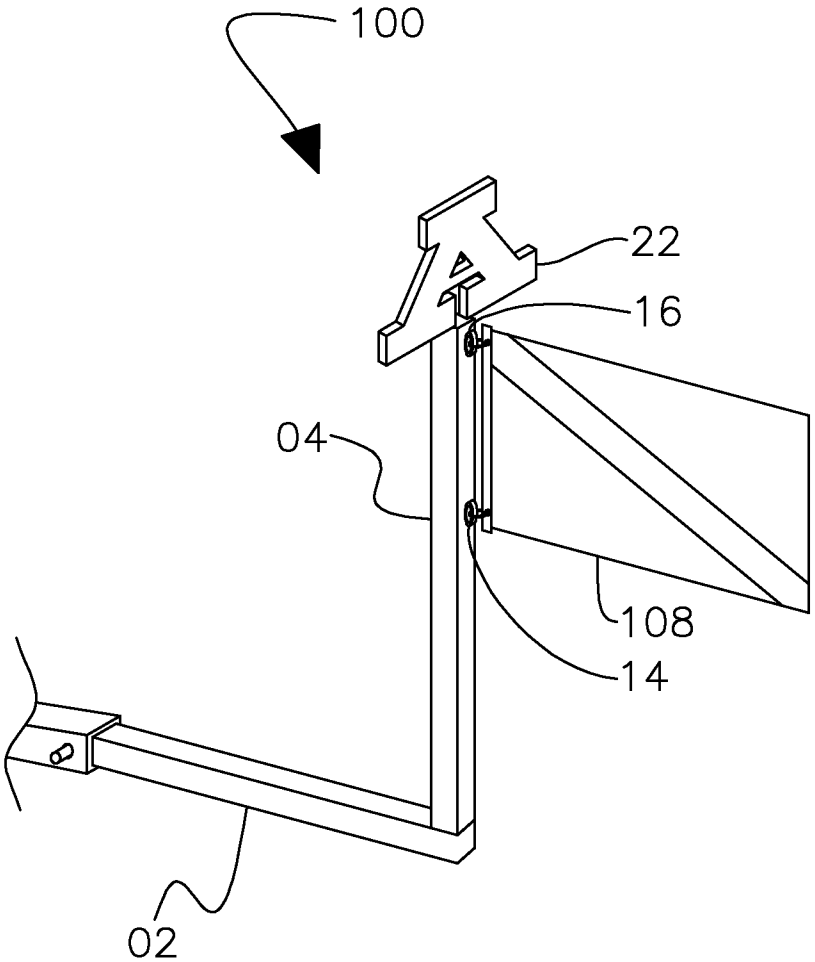
FIG. 7 illustrates a top perspective view of a flag pole assembly including a third ornament attached near the top of the vertical member, in accordance with an embodiment of the invention.

In another embodiment of the invention, as shown in FIG. 7, a third ornament 22 is attached above the first ornament 108 and near the top of the vertical member 04 to further exhibit team pride. The third ornament 22 is a team name, logo, graphic, or mascot that is made of metal, plastic, or another man-made material and is attached near the top of vertical member 04 in various ways, including but not limited to welding, bonding, and fastening.

Figure 8:
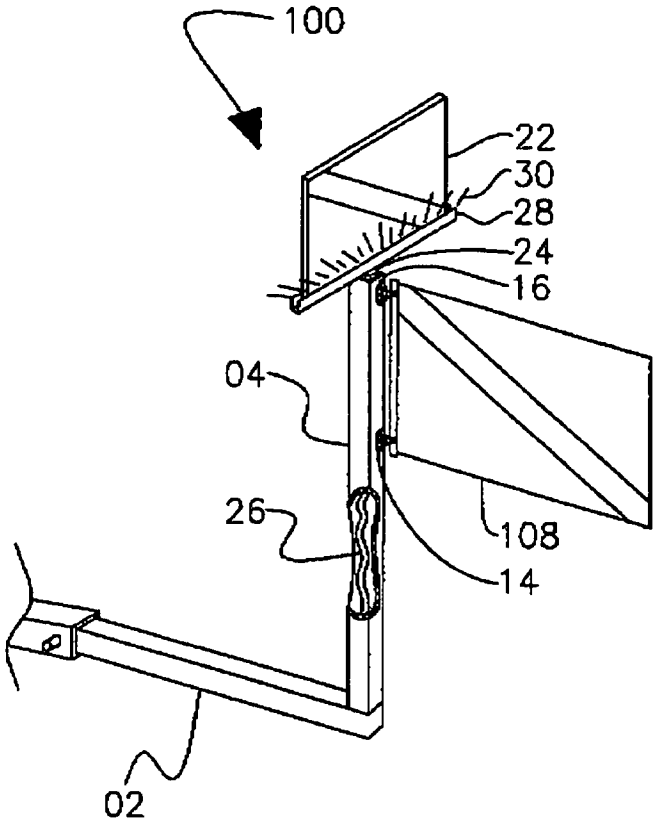
FIG. 8 illustrates a top perspective view of a flag pole assembly including an alternative embodiment of the third ornament attached near the top of the vertical member, a light source providing illumination to the third ornament, and an electrical conduit located within the horizontal and vertical members, in accordance with an embodiment of the invention.
Figure 10:
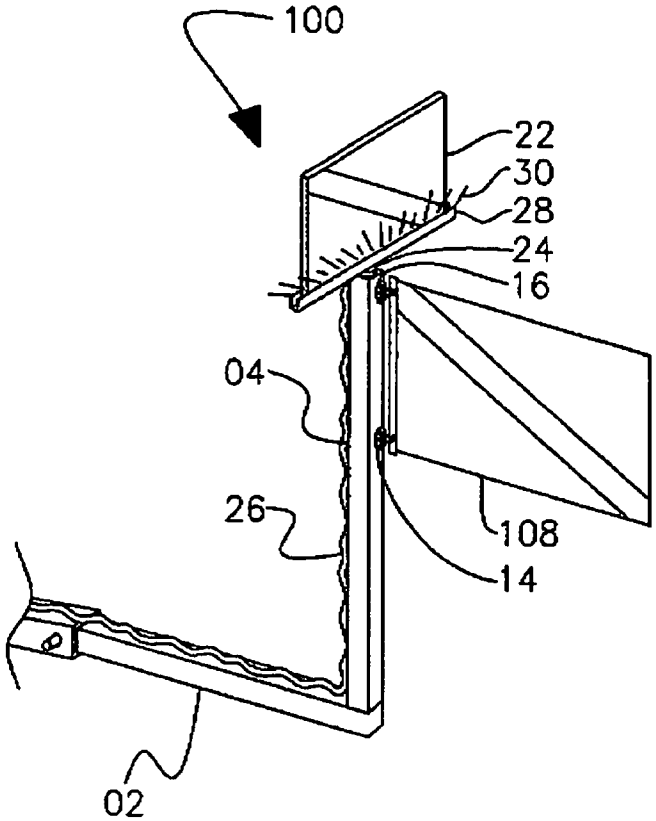
FIG. 10 illustrates a top perspective view of a flag pole assembly including an alternative embodiment of the third ornament attached near the top of the vertical member, a light source providing illumination to the third ornament, and an electrical conduit located on the exterior surface of the horizontal and vertical members, in accordance with an embodiment of the invention.

Another embodiment of the third ornament 22 is shown in FIG. 8. The horizontal member 02 and vertical member 04 are hollow. The third ornament 22 includes a plug 24 that fits inside the top of the vertical member 04 and securely fastens the third ornament 22 to the top of vertical member 04. An electrical conduit 26 is located inside the hollow horizontal member 02 and vertical member 04. In this way, the vertical and horizontal members 02, 04 protect the electrical conduit 26 from weather and incidental damage. The electrical conduit 26 extends out the first end of the horizontal member 02 and attaches to the vehicle's power source. The opposite end of the electrical conduit 26 extends out the top end of vertical member 04 and attaches to a light source 28. The light source 28 is operable to emit illuminating rays 30 and thereby make this embodiment of the third ornament 22 visible at night. In an alternative embodiment, a battery can be used, instead of the vehicle's power source, to provide power for the light source 28. Alternatively, the electrical conduit 26 may be fastened to the outside surfaces of horizontal member 02 and vertical member 04 as shown in FIG. 10.

Figure 9:
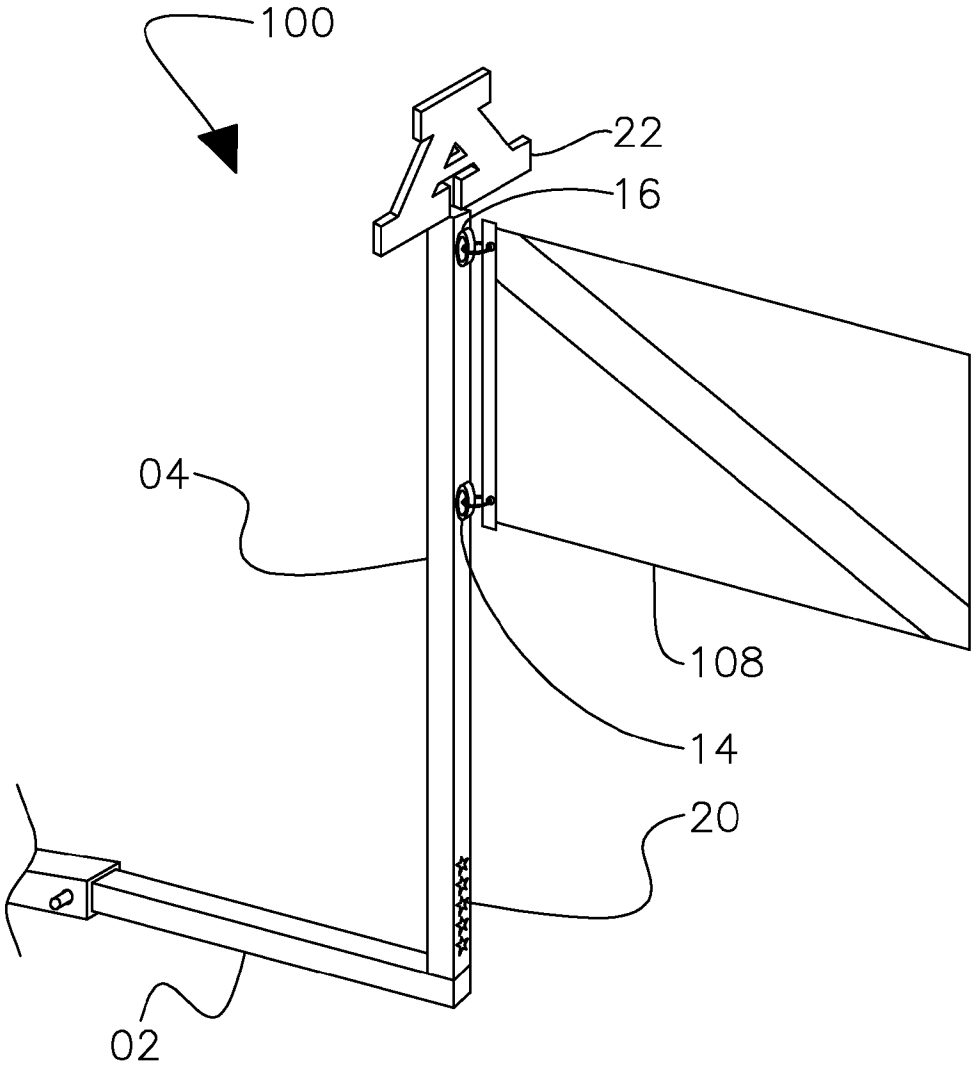
FIG. 9 illustrates a top perspective view of a flag pole assembly including a first, second, and third ornament attached to the vertical member, i.e., the first ornament is attached near the top of the vertical member, the second ornament is attached near the base of the vertical member, and the third ornament is attached near the top of the vertical member, in accordance with an embodiment of the invention.

In another embodiment of the invention, as shown in FIG. 9, the flag pole assembly 100 includes three ornaments attached to the vertical member 04, i.e., a first ornament 108 is attached to the vertical member 04 by attachment links; a second ornament 20 is attached near the base of the vertical member 04; and a third ornament 22 is attached near the top of the vertical member 04.

Thus, there has been described a flag pole assembly 100. It is apparent to those skilled in the art, however, that many changes, variations, modifications, other uses, and applications are possible and also such changes, variations, modifications, other uses, and applications which do not depart from the spirit and scope of the invention are deemed covered by the invention, which is limited only by the claims which follow.

What is claimed is:

1. A flag pole assembly for use with a vehicle having a trailer hitch, comprising:

a horizontal member having first and distal ends, wherein the horizontal member includes a first hole in the first end to attach the horizontal member to the hitch of a vehicle and a securing tab near its distal end, the securing tab being biased towards a secured configuration, the horizontal member being least thirty inches long;

a vertical member coupled to the distal end of the horizontal member and extending upward; and at least one attachment link affixed to the vertical member for attaching a first ornament.

2. The flag pole assembly of claim 1, wherein the horizontal member includes at least a second hole near the distal end, and the vertical member includes at least a third hole, and further including a fastener, wherein the fastener is inserted through the second and third holes, thereby coupling the distal end of the horizontal member to the base of the vertical member.

3. The flag pole assembly of claim 1, further comprising a second ornament, wherein the second ornament is attached near the base of the vertical member.

4. The flag pole assembly of claim 1, further comprising a third ornament, wherein the third ornament is attached near the top end of the vertical member.

5. The flag pole assembly of claim 4, further comprising an electrical conduit, wherein the electrical conduit is connected to a power source at one end and a light source at the opposite end and the light source is operable to illuminate the third ornament.

6. The flag pole assembly of claim 5, wherein the power source is a vehicle auxiliary power system.

7. The flag pole assembly of claim 5, wherein the power source is a battery.

8. The flag pole assembly of claim 5, wherein the electrical conduit is located on the exterior surface of the horizontal member and vertical members.

9. The flag pole assembly of claim 5, wherein the horizontal and vertical members are hollow and the electrical conduit is located within the horizontal and vertical members.

* * * * *